US005375910A

United States Patent [19]

Murphy

[11] Patent Number: 5,375,910

[45] Date of Patent: Dec. 27, 1994

[54] SEAT ELEVATING DEVICE

[75] Inventor: Lloyd Murphy, Cave Creek, Ariz.

[73] Assignee: Air Physics Corporation, Cave Creek, Ariz.

[21] Appl. No.: 208,230

[22] Filed: Mar. 10, 1994

[51] Int. Cl.[5] ..... A47C 1/08

[52] U.S. Cl. ..... 297/256.13; 297/283; 297/313; 297/DIG. 10

[58] Field of Search ..... 297/256.13, 256.11, 297/283, 337, 338, 313, 219.1, 228, DIG. 10; 5/453, 454, 455, 456, 461

[56] References Cited

U.S. PATENT DOCUMENTS

| | | | |
|---|---|---|---|
| 3,192,540 | 7/1965 | Swank | 297/283 X |
| 3,479,087 | 11/1969 | Burke | 297/339 |
| 4,592,589 | 6/1986 | Hellwig | 297/284 |
| 4,629,162 | 12/1986 | Porché | 254/93 |
| 4,905,329 | 3/1990 | Heilner | 5/431 |

*Primary Examiner*—Laurie K. Cranmer
*Attorney, Agent, or Firm*—Leo Gregory

[57] ABSTRACT

An elevating member to be disposed upon the seat of a chair to elevate to a raised position the body of a person thereon, the elevating member comprising a pair of overlying plate members being hinged at one side thereof and having a seat supporting surface thereon, the same being hinged as at the front of a seat, said members lying over two sides of an expandable member, means retaining the side walls of said expandable member forming an airtight chamber, a low pressure air supply being connected with said chamber inflating the same and angling the upper of said plate members upwardly and forwardly elevating a person seated thereon to an erect position, this device being particularly adapted for use by persons having difficulty rising to a standing position.

5 Claims, 5 Drawing Sheets

SEAT ELEVATING DEVICE

BACKGROUND OF THE INVENTION

1. Field of Invention

Relates to an elevating device to be disposed upon a seat to assist in elevating to a standing position a person seated thereon who otherwise would experience difficulty in an effort to arise to a standing position without assistance, said device having a pair of overlying seating members hinged at one edge portion thereon and having an expandable air chamber formed therebetween, the top seating member being elevated to an angle from rear to front relative to the seating position thereon to raise to a standing position a person seated thereupon.

2. Description of the Previous Art

There are known prior art devices present which embody the purpose which is indicated by the applicant's.

In U.S. Pat. No. 4,629,162, an inflatable airbag is shown somewhat wedge shaped to assist a person to lower himself to a seating position thereupon by deflatation of the bag.

In U.S. Pat. No. 3,479,087, there is shown a pneumatic tube secured to seat plates having selective means to inflate or deflate the tube to cause a seat plate to raise a person to virtually standing position.

In U.S. Pat. No. 4,592,589, there is shown a series inflatable groove separated seat cushions to provide a padded seat tapered downwardly forwardly.

In U.S. Pat. No. 4,998,301, there is disclosed a wedge shaped member forming a bedpan support having an upper supporting surface which can be raised sufficiently to insert a bedpan thereunder.

Finally, in U.S. Pat. No. 4,905,329, there is shown a pair of tapered inflatable rings secured together at their overlying tapered portions wherein the rings are inflatable with the rear portions thereof relative to a person seated thereon increasing sufficiently to raise the seated person to enable that person to stand.

SUMMARY OF THE INVENTION

It is a primary object to provide a device to be disposed upon a seat member as of a chair or a wheelchair, the device being particularly adapted to assist in elevating to a standing position a person seated thereupon who otherwise would have difficulty in arising. Also, many seats are so low as to be below a seated person's center of gravity and the person seated thereupon needs assistance to arise.

It is a further object herein to provide a device comprising an inflatable member disposed between a pair of overlying member hinged at one edge portion thereof, the upper of the members being adapted to assist in raising to a standing position a person seated thereupon.

More particularly it is an object herein to provide an elevating device comprising a pair of hinged seating members, one overlying the other, and having an inflatable chamber formed therebetween, said device being disposed as upon a seat with the hinged portion of said members at the front of said seat and an air supply in connection therewith to elevate the overlying plate member forwardly to assist in raising to a standing position the person seated thereupon.

With reference to the previous object, it is also an object herein to have said inflatable chamber become slowly deflated to assist in lowering a person to assume a seating position.

These and other objects and advantages of the invention will be set forth in the following description made in connection with the accompanying drawings in which like reference characters refer to similar parts throughout the several views.

BRIEF DESCRIPTION OF THE DRAWINGS

FIG. 1. Is an enlarged view of the invention in perspective in operating position connected to an air supply;

DESCRIPTION OF A PREFERRED EMBODIMENT

Figure 2:
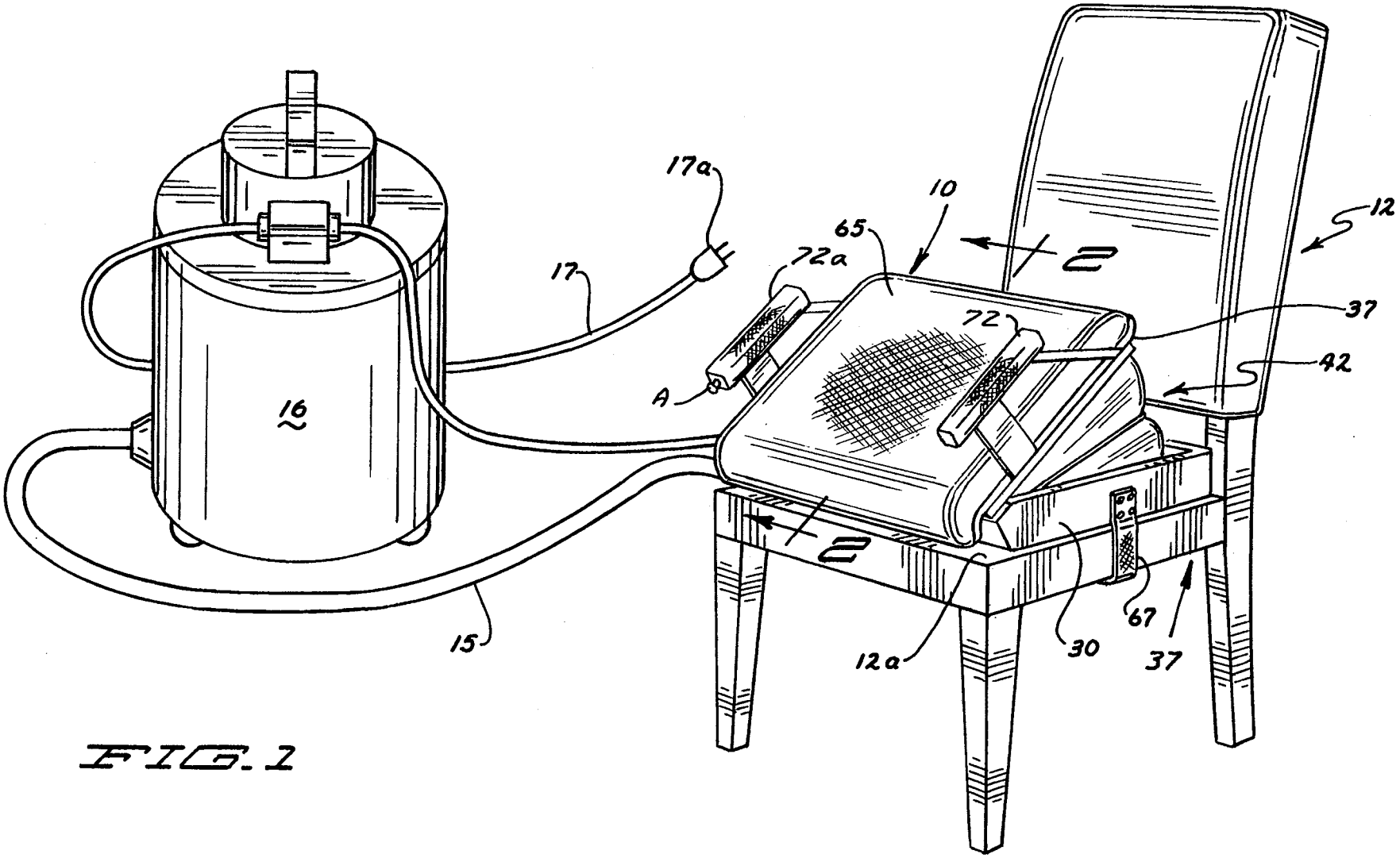
FIG. 2 is a view in vertical section on an enlarged scale taken on line 2—2 of FIG. 1, as shown.
Figure 2:
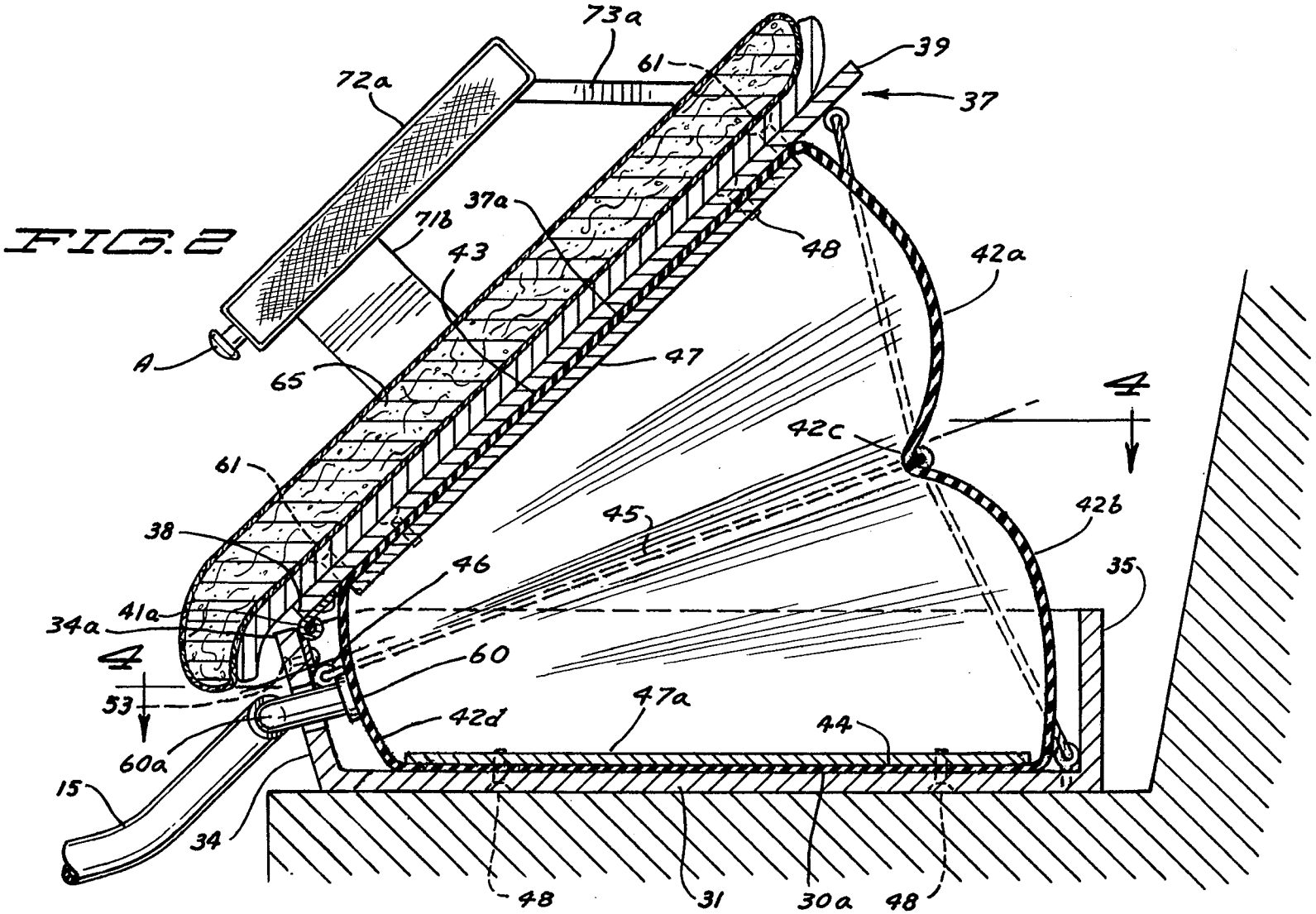

Referring to FIG. 1 of the drawings, the seat forming elevating device comprising the invention herein is indicated generally by the reference numeral 10. For purpose of illustration, said invention is shown disposed upon the seat 12*a* of a chair 12 and is connected to by air hose 15 running to an air tank or turbine 16 for a source of pressurized air. Said turbine is connected to an electrical cord 17 extending to a power source. Said cord is shown having a terminal plug 17*a* for connection with a convenient electrical outlet. The member 16 is merely representative of a convenient source of pressurized air.

Through internal wiring of said chair, not here shown, a switch button A is in circuit with a power cord 15 running to said turbine. Said switch button A actuates the turbine subject to a two second delay to provide pressurized air for elevating purposes. Said button is an on-off switch button and with the turbine turned off, air leaks out slowly for deflatation purposes. This is conventional structure and operation.

Thus the action of the turbine for inflation is not an abrupt action but is a comfortable action. If desired, by so operating the switch button, an incremental action may be achieved for raising the seat.

Now, in turning to the elevating device itself, it comprises a bottom member 30 which has some depth to contain a bladder-like inflatable member to be described.

Said bottom member 30 has a bottom wall 31, side walls 32 and 33 and end walls 34 and 35. The end wall 34 is shown to be angled outwardly as in FIG. 2.

Said bottom wall is indicated here as having a level smooth inner surface. However it is noted that if additional stiffness or rigidity may be required, the bottom wall may be formed to have a waffle like contoured surface which would enhance the rigidity of said bottom wall.

Prototypes have been made of $\frac{1}{4}$ inch ABS plastic sheets and these have been found to be very satisfactory. A seat size suggested for use is $18 \times 16$ inches-this particularly to fit into the seat of a wheelchair. Very little air pressure is required to elevate up to a 288 pound person. Sufficient lift can be provided with approximately 1 or 2 psi. Hence provided is a very safe to use device and absent is any hazardous explosive force.

Figure 3:
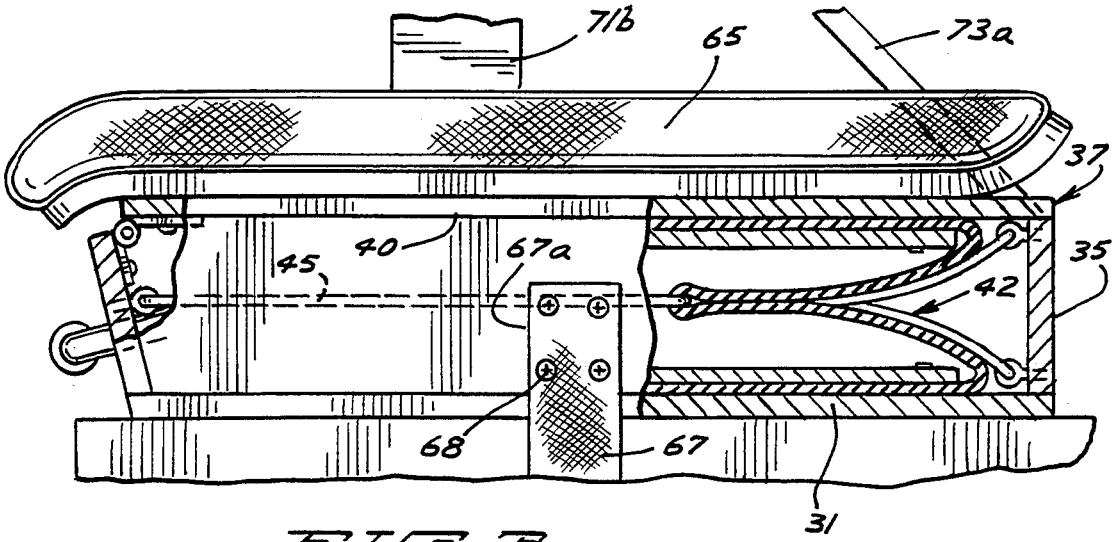
FIG 3 is a view in side elevation of the overlying members of the invention in lowered condition with a portion broken away to show a detail of structure.

Overlying said bottom member 30 and supported thereon is a top overlying wall member 37 having end walls 38 and 39, FIG. 3, and side walls 40 and its opposing side wall which is not shown.

Said top and bottom walls are hingedly connected along their respective ends 34*a* and 38 and connecting the same is a conventional elongated hinge 41*a*.

Said bottom and top walls have facing surfaces 30*a* and 37*a*. Disposed between said facing surfaces is a bladder-like inflatable member 42 having its top and bottom sides or walls 43 and 44 suitably secured as by an appropriate adhesive or other fastening means, i.e., snaps or zippers, to said adjacent facing surfaces 37*a* and 30*a* of said overlying and underlying top and bottom wall members. Also underlying said top and bottom walls 43 and 44 of said bladder are plate members 47 and 47*a* fastened by bolts 48 to further secure said bladder to said facing wall surfaces.

Said bladder or inflatable member 42 is inflatable to the extent of tilting upwardly the upper wall member 37 on the order of 60° in the direction of the hinge 41*a*. This is deemed to be adequate to elevate the user to a sufficiently erect position that the user can readily stand.

Figure 4:
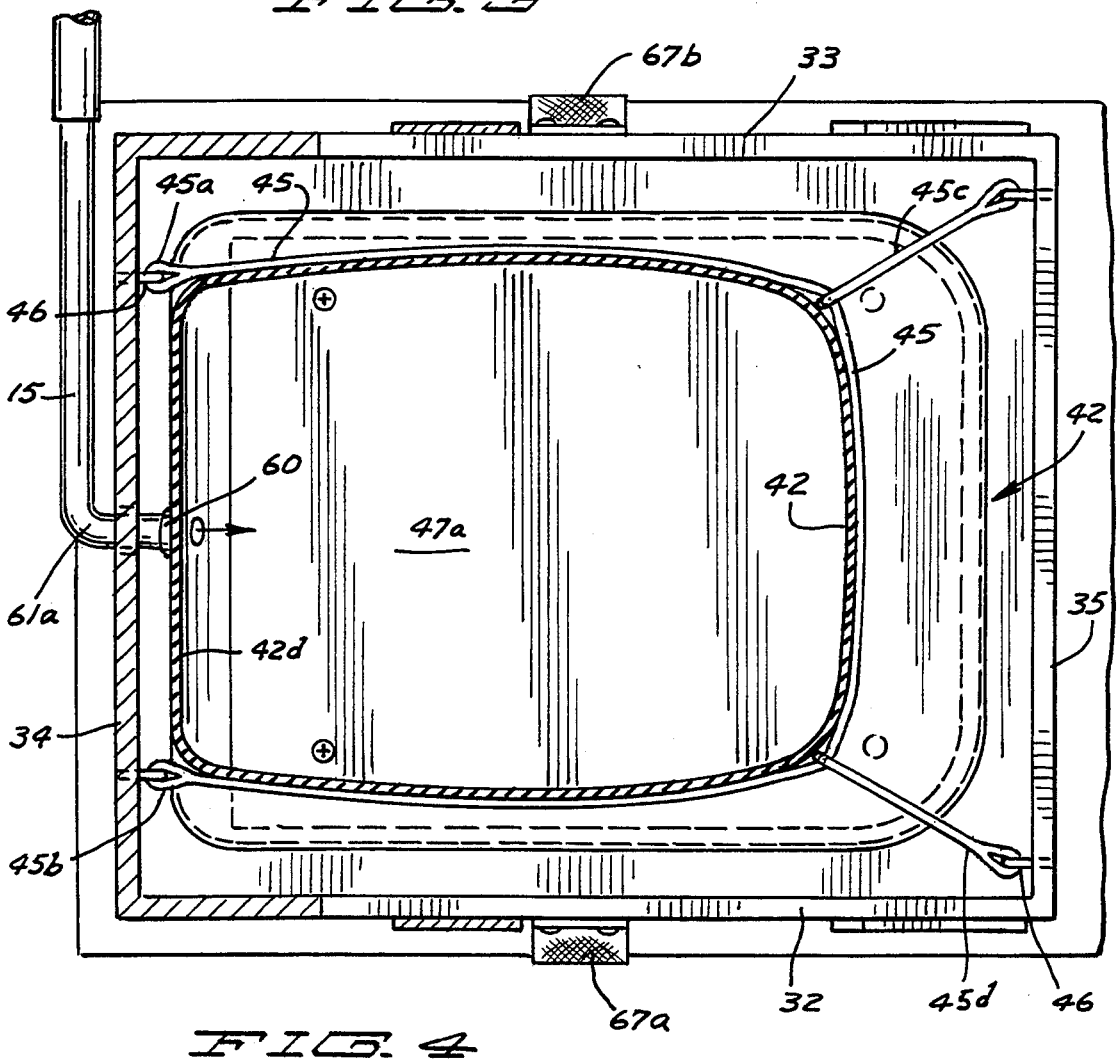
FIG. 4 is a view in horizontal section taken on line 4—4 of FIG. 2 as indicated.

Said bladder 42 as indicated in FIG. 2 is somewhat heart shaped in vertical longitudinal section and as having a pair of front lobes 42*a* and 42*b*. Between said lobes as at 42*c* and extending rearwardly at each side of said bladder as in FIG. 4 is an elastic cable 45 having its looped ends 45*a* and 45*b* secured by ring headed screw members 46 to said rear end wall 34. Each side of the front end of said cable 45 by short cable members 47 and 47*a* is secured to the front end wall 35 by ring headed screw members 46.

Thus upon inflation, said bladder 42 will be confined within the perimeters of said upper and lower wall members 37 and 31.

Secured to the end wall 42*d* of said bladder is a vent 60 having an outwardly extending stem portion 60*a* which joins said air hose 15 to be integral therewith.

A PVC or polyurethane coated nylon fabric has been found to be very suitable for making said inflatable bladder.

Attached to the upper outer side of said top member 37 and secured thereto by screws 61 is a suitably cushioned seating member 65. It is readily seen that the particular cushioning desired is a matter of personal choice.

Referring now to FIGS. 1, 3, and 4, shown is one manner in which the elevating member 10 may be secured to a seat such as of the chair 12. Shown in partial view is a band or strap member 67 of which end portions 67*a* and 67*b* are shown secured to the opposite side walls 32 and 33 of said device 10 by screws 68. Said strap has its free end portions not shown in being under the seat of said chair and these end portions are equipped with a buckle for securing together said end portions under said seat in a known manner.

Figure 5:
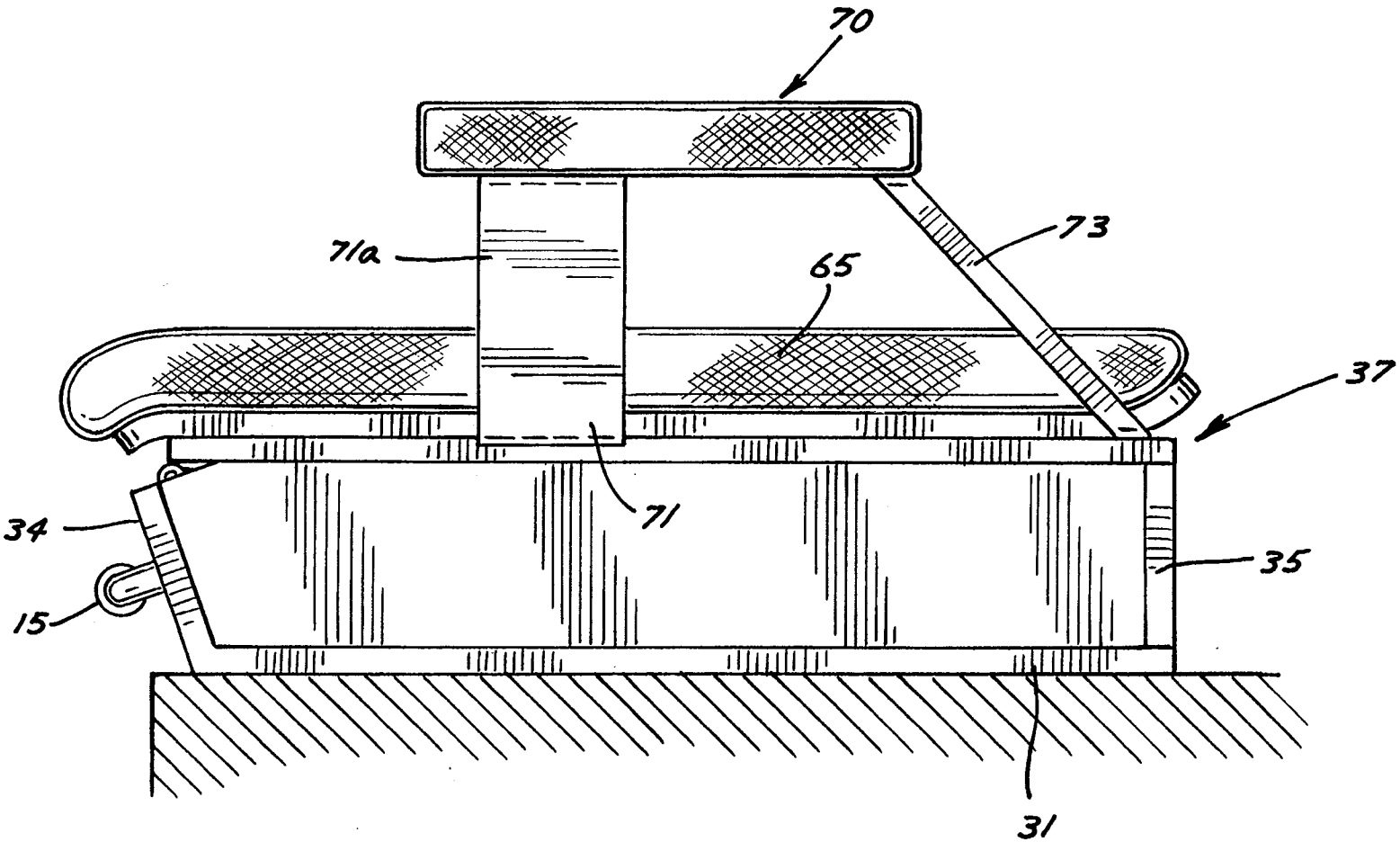
FIG. 5 is a view in side elevation of the invention herein.

Referring now to FIGS. 1, 2, and 5, a hand hold 70 is shown which comprises an elongated rigid band member 71 underlying the upper seat member 37 and extending thereacross thereunder in a recessed channel not shown and the same is suitably secured thereunder.

Said band member has arms 71*a* and 71*b* extending upwardly of each side of said member 37 sufficiently for convenient hand placement and secured to the upper ends of said arms are hand holds 72 and 72*a* formed of tubular members square or round in cross section, as may be desired, and having a suitable length for holding purposes. Extending rearwardly of said hand holds and being angled downwardly to be suitably secured to rear wall portions of said member 37 are struts 73 and 73*a* to secure said hand hold members. The hand hold member 72*a* is wired to have said turbine switch button A in circuit with said electrical conduit 17 and thus with said turbine to operate the same. The wiring is conventional and not shown.

OPERATION

It will be understood that the air turbine here shown is merely illustrative of a pressurized air source. There are a variety of such devices available.

With reference to FIG. 1, ordinarily when the elevating device is not in use, the switch button A will be in an off position and this results automatically after a use and a short waiting period thereafter. The seat will thus be elevated in FIG. 1 for illustrative purposes.

The upper seating member is elevated by engaging the button switch A to turn on the air turbine 16 to inflate said bladder either to lower a person to a seating position or elevate a user to a rising position.

The bladder upon being inflated raises the elevated seating member on the order of 13 inches and moves the user forwardly, in rising, on the order of 8 inches. Thus the user is very nicely positioned whereby the user can readily rise to an erect or standing position. As has been indicated, very little air pressure is required and the pressure of the air presents no hazard.

MODIFICATION

Figure 6:
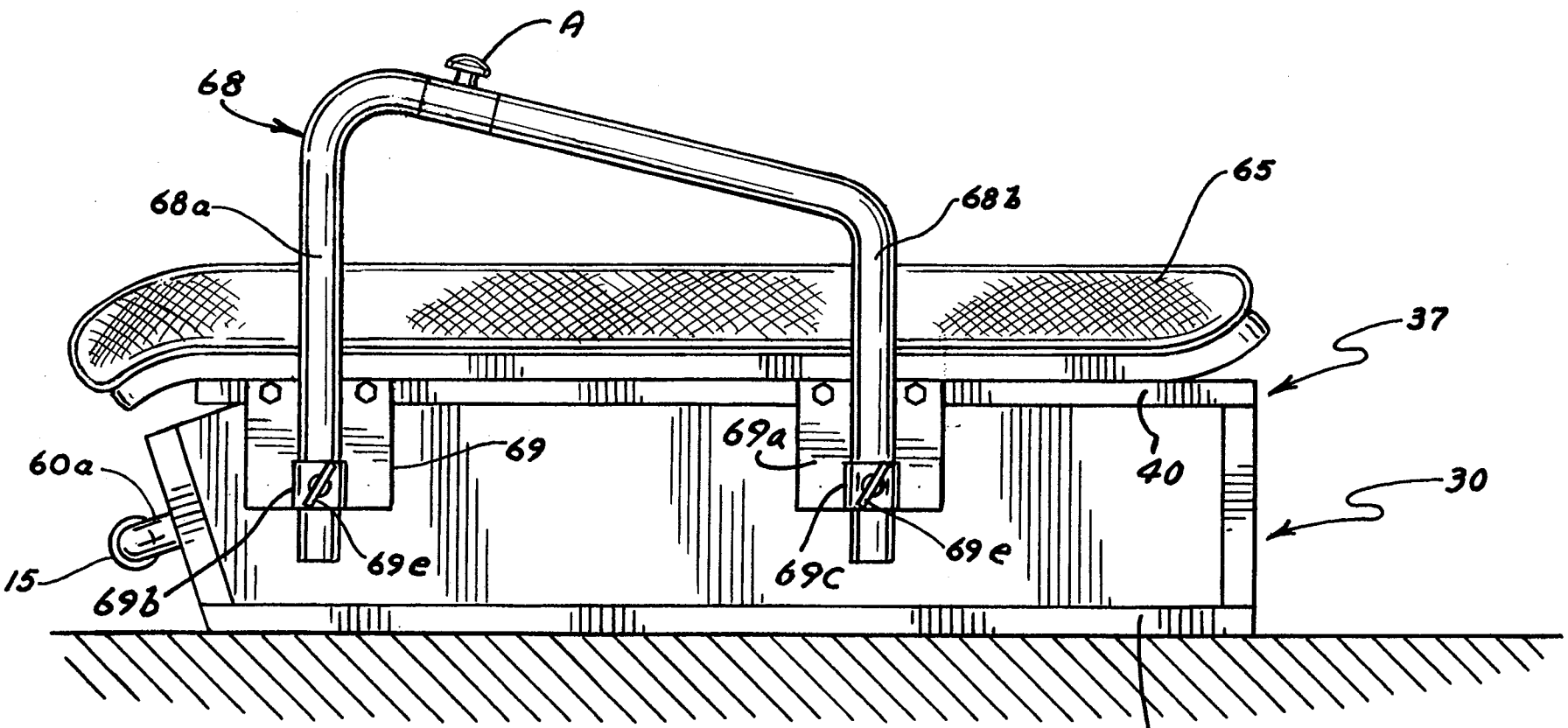
FIG. 6 is a view in side elevation similar to FIG. 5 showing a modification of the invention herein.

Referring to FIG. 6, an optional hand hold or handle 68 is shown and is illustrated as being generally U-shaped in tubular form having its depending end portions 68*a* and 68*b* received into a pair of angled brackets 69*b* and 69*c* carried by the plate brackets 69 and 69*a* which are secured to the side wall. 40 of said upper seating member 37. Said depending portions are secured in said brackets by threaded pressure pins 69*e* hand hold is shown carrying the turbine switch button A.

A second like hand hold member will be installed oppositely on the opposing side wall of said member 37.

It will of course be understood that various changes may be made in the form, details, arrangement and proportions of the invention herein without departing from the scope of the invention herein which, generally stated, consists in a product capable of carrying out the objects above set forth, such as disclosed and defined in the appended claims.

What is claimed:

1. A seat elevating device to assist to a standing or seating position a person who otherwise would have difficulty in arising or sitting, having in combination a pair of overlying and underlying seat forming members to be disposed upon a single seat, said seat forming members being somewhat elongated forming end portions, means hinging a pair of adjacent of said end portions, said hinged end portions being disposed at the front portion of a seat, said overlying and underlying members having facing surfaces, flexible airtight material forming a bladder comprising an inflatable chamber between said facing surfaces, said bladder having its top and bottom walls overlying said facing surfaces, a pair of rigid plate members disposed within said bladder to overlie inner sides of the top and bottom walls thereof and to secure the same to said overlying and underlying members causing said bladder to be confined therebetween, said material causing a substantial separation of unhinged end portions of said seat forming members sufficiently upon the inflation of said chamber to assist a seated person to arise, and means inflating said chamber.

2. The structure of claim 1, wherein said underlying member having a recess formed therein to receive said material forming said inflatable chamber.

3. The structure of claim 1, wherein said material embodies a central longitudinal crease therein, and said underlying member has a recess formed therein receiving said material in deflated form.

4. A seat elevating device to assist to a standing position a person who otherwise would have difficulty in arising, having in combination a pair of overlying and underlying seat forming members to be disposed upon a single seat, said members having hinged front end portions, said pair of members having inner facing surfaces, a flexible airtight material disposed between said inner facing surfaces forming a bladder comprising an inflatable chamber, rigid plate members within said bladder overlying inner sides of top and bottom walls thereof securing the same to said overlying and underlying members, said underlying member having a recess formed therein to receive said material forming said chamber, means confining said chamber upon inflation between said overlying and underlying members, means inflating said chamber, said chamber being adapted to be inflated to elevate upwardly on the order of 60 degrees the portion of said overlying member remote from the hinged portion thereof, whereby a person seated thereupon is raised to a sufficiently erect position to be able to stand.

5. The structure of claim 4, including a pair of hand holding members, a switch operating said inflating means carried by one of said hand holding members, and said switch being adapted to cause the inflation and deflation of said chamber.

* * * * *